US006354763B1

(12) United States Patent
Ishikawa et al.

(10) Patent No.: US 6,354,763 B1
(45) Date of Patent: Mar. 12, 2002

(54) PUMPING PLANT

(75) Inventors: Seiichi Ishikawa; Shizuichi Sakamoto; Tsuyoshi Yoshida; Saburou Maru, all of Ibaraki-ken (JP); Stefan Emsmann, Niedernhausen; Hans Pitz, Kronberg im Taunus, both of (DE)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/257,034

(22) Filed: Feb. 25, 1999

(30) Foreign Application Priority Data

Feb. 27, 1998 (JP) ..... 10-047135

(51) Int. Cl.[7] ..... E02B 1/00
(52) U.S. Cl. ..... 405/127; 405/303; 210/170
(58) Field of Search ..... 405/127, 41, 80; 210/163, 170

(56) References Cited

U.S. PATENT DOCUMENTS

| | | | | |
|---|---|---|---|---|
| 246,655 | A | * 8/1881 | Bramhall | 405/127 |
| 2,361,231 | A | * 10/1944 | Nebolsine | 405/127 |
| 3,061,276 | A | * 10/1962 | Homan | 405/127 |
| 4,335,977 | A | * 6/1982 | Ihli | 405/127 |
| 5,052,855 | A | * 10/1991 | Chapman et al. | 405/127 |

FOREIGN PATENT DOCUMENTS

| | | |
|---|---|---|
| JP | 6360100 | 4/1988 |

* cited by examiner

*Primary Examiner*—David Bagnell
*Assistant Examiner*—John Kreck
(74) *Attorney, Agent, or Firm*—Antonelli, Terry, Stout & Kraus, LLP

(57) ABSTRACT

A pumping pant which is more compact in size and has reduced total costs required for construction work of the pumping plant and associated civil engineering works and has a shorter term of the entire construction work includes a pump building which is constructed in its entirely as an island-type building in the form of an island in a suction pond serving as a pump well, whereby the need to refill earth and sand around the pump building is eliminated, and the cost of associated civil engineering works is reduced. Water is sucked from all sidewalls of the pump building, and pumps are arranged within the pump building in at least two rows, resulting in a reduced length of the building. Horizontal portions of a suction pipe and a delivery pipe are extended from the pump in the same direction to reduce a width of the building and to make it compact. A total cost required for the construction of the pump building and associated civil engineering works can be thus reduced. Two ceiling cranes are installed in a one-to-one relationship to the pumps in two rows, enabling the pumps, etc., in both rows to be installed at the same time. This also contributes to cutting down a term of the entire construction work.

7 Claims, 6 Drawing Sheets

PUMPING PLANT

BACKGROUND OF THE INVENTION

1. Field of the Invention

The present invention relates to a pumping plant and a water conveying system, which are used for discharging or supplying water or for other purposes.

2. Description of the Related Art

To cope with the problem of water shortage occurred in many districts of the world, water conveying systems are installed in those districts for introducing water taken in from lakes or the like to pumping plants through suction water conduits, lifting the water by pumps provided in the pumping plants, and supplying the water to the destination, i.e., the target districts, through delivery water conduits.

One example of pumping plants according to the related art is shown in FIGS. 5 and 6. FIG. 5 is a vertical sectional view of a pumping plant, and FIG. 6 is a sectional view taken along line VI—VI in FIG. 5 and viewed in a direction denoted by arrows. Such a known pumping plant is disclosed in, for example, Japanese Unexamined Utility Model Publication No. 63-60100. In FIG. 5, water incoming through a suction water conduit 1 flows into a pump well 2. The water in the pump well 2 is sucked by a pump 6 through a suction pipe 5 from a suction port 4 which is formed in a longitudinal side wall of the pumping plant 3 at its lower end. The water sucked by the pump 6 is sent to a destination unit (not shown), such as a delivery water tank, through a delivery pipe 7.

When constructing the above-mentioned pumping plant 3, there are three possible methods of constructing a pump building 13 on the ground, or constructing it under the ground, or constructing a part of the pump building 13 under the ground. Generally, the pump building 13 must be constructed under the ground in many cases for the unavoidable reason from the standpoints of the height of a water suction level, the performance of the pump 6, etc. In the case of constructing the pump building 13 under the ground, it is customary to construct the pumping plant 3 by digging down the ground in the construction site, and then to refill earth and sand around the pumping plant 3.

Further, as shown in FIG. 6, a plurality of pumps 6 are arranged within the pumping plant 3 to lie in a line extending in a direction substantially perpendicular to the direction of flow of the water that is introduced to the pumping plant 3 from the suction water conduit 1. Usually, a ceiling crane 9 is installed for mounting equipment used in the pumping plant 3, such as the pumps 6 and motors 8 for driving the pumps 6. The delivery pipe 7 is installed on the side opposite to the suction pipe 5 with the pump 6 between them. Valves 10, 11 to be provided midway the delivery pipe 7 are disposed in a horizontal portion of the delivery pipe 7.

The conventional pumping plant 3 described above has a large size in the longitudinal direction of the pump building 13 because a plurality of pumps are arranged in one row. For the same reason, if only one ceiling crane 9 is installed, it is impossible to simultaneously mount plural units of equipment such as the pumps 6 and the motors 8.

In addition, the size of the pump building 13 in the widthwise direction thereof is also increased because of such a construction that the suction pipe 5 and the delivery pipe 7 of the pump are installed on the opposite sides with respect to the pump 6, and that the valves 10, 11 are disposed in the horizontal portion of the delivery pipe 7.

Consequently, the pumping plant 3 has a large size, thus resulting in an increase of total cost required for construction work of the pumping plant 3 and associated civil engineering works such as digging down the ground, and a longer term of the entire construction work.

SUMMARY OF THE INVENTION

A first object of the present invention is to construct a building of a pumping plant in compact size, and to cut down a cost of construction work.

A second object of the present invention is to cut down a cost of civil engineering works associated with construction of a pumping plant.

A third object of the present invention is to realize cutdown of a term required for installation work of pumps.

To achieve the above objects, according to a pumping plant of the present invention, a pump building is constructed such that at least a part of side walls of the pump building is submerged under water in a suction pond constructed at an end of a suction water channel opposite to a water taking-in point, suction openings are provided in the submerged side wall, and suction ports of pumps are communicated with the suction openings. With this feature, since there is no need of refilling earth and sand around the side wall of the pump building submerged under water in the suction pond, a cost of civil engineering works associated with the construction of the pumping plant can be reduced.

In the above pumping plant, preferably, the entirety of the pump building is constructed in a position spaced from the bank of the suction pond, i.e., within the suction pond. Specifically, the suction pond is constructed at a terminal end of the suction water channel, and an island-type building of the pumping plant is constructed in the suction pond. The reason of using the term "island-type" is that a part of the pumping plant is submerged under the water of the suction pond, and therefore the building of the pumping plant appears as if it is an island in the suction pond. With this feature, works for refilling earth and sand around the pump building can be all omitted.

By constructing the island-type building, it is possible to suck water from all side surfaces of the building of the pumping plant, and to arrange the pumps within the pump building in multiple rows including, e.g., two. For example, by arranging the plurality of pumps within the pump building in two rows to lie in the direction of flow of the water introduced from the suction water channel to the suction pond, the water can be sucked by both the pumps in both rows in a well balanced manner. Also, since ceiling cranes can be installed in a one-to-one relationship to the pumps in two rows, installation works for the pumps, motors, etc. in two rows can be performed at the same time, thus resulting in a reduction of a term of the entire construction work. Further, no need of refilling earth and sand around the pumping plant contributes to reducing the cost of civil engineering works associated with the construction of the pumping plant and cutting down a term of the entire construction work.

Furthermore, in the case of arranging the pumps in two rows, it is preferable that a delivery pipe of each of the pumps is disposed on the same side as a corresponding suction pipe with respect to the pump, namely the suction pipe and the deliver pipe are extended horizontally from the pump in the same direction, that the two pipes are positioned in a vertically spaced relationship, and that a valve for the delivery pipe is mounted in a vertical portion of the delivery pipe. With this feature, the width of the pumping plant can be reduced, and the pumping plant can be constructed in compact size. As a result, a total cost required for construction work of the pumping plant and associated civil engineering works such as digging down the ground can be reduced.

DESCRIPTION OF THE PREFERRED EMBODIMENTS

Figure 1:
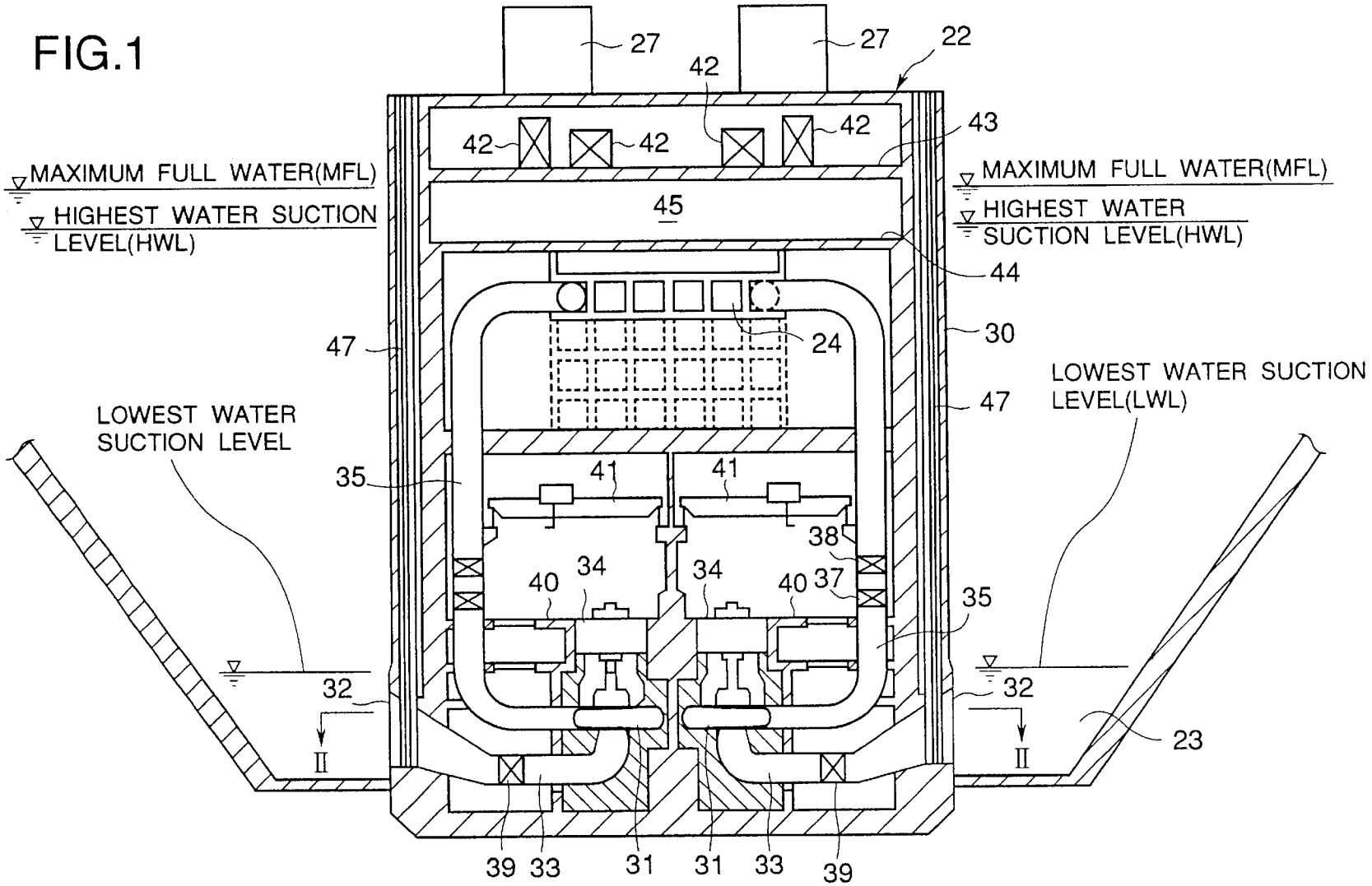
FIG. 1 is a vertical sectional view of a pumping plant according to one embodiment of the present invention.
Figure 2:
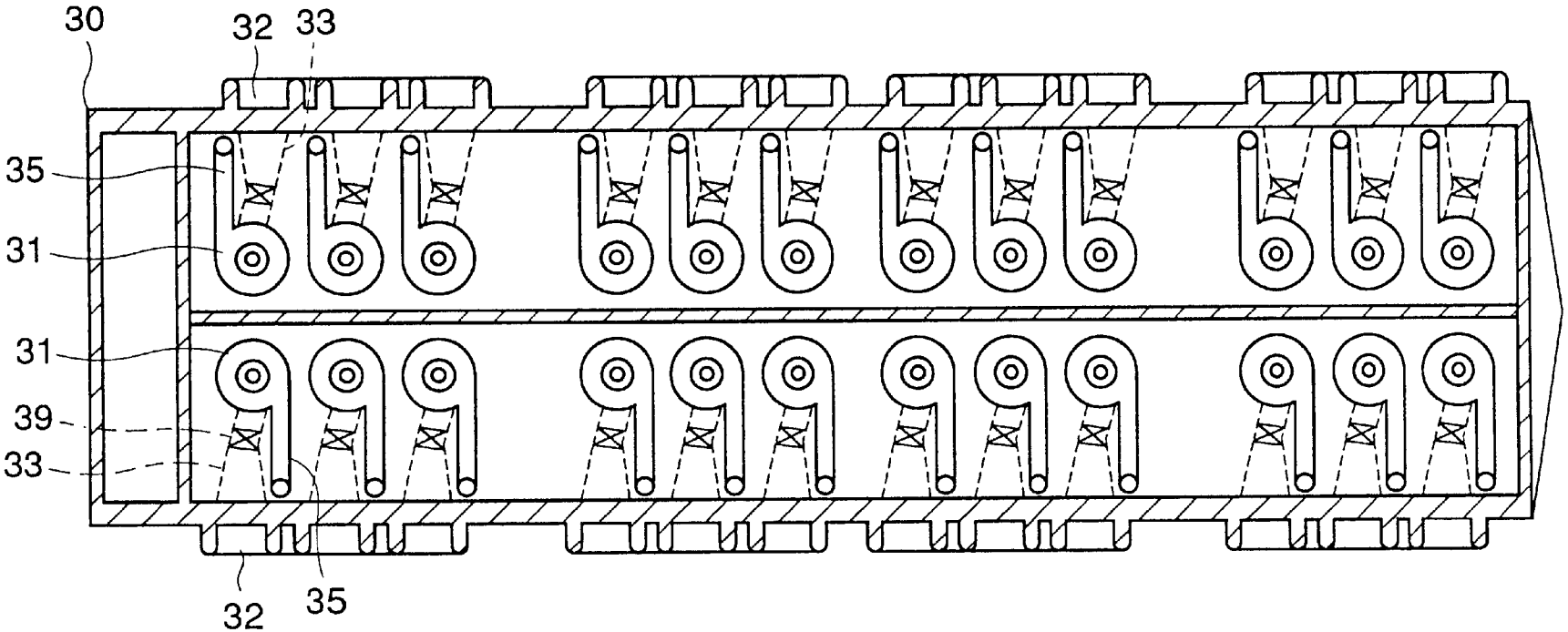
FIG. 2 is a sectional view taken along line II—II in FIG. 1 and viewed in a direction denoted by arrows.
Figure 3:
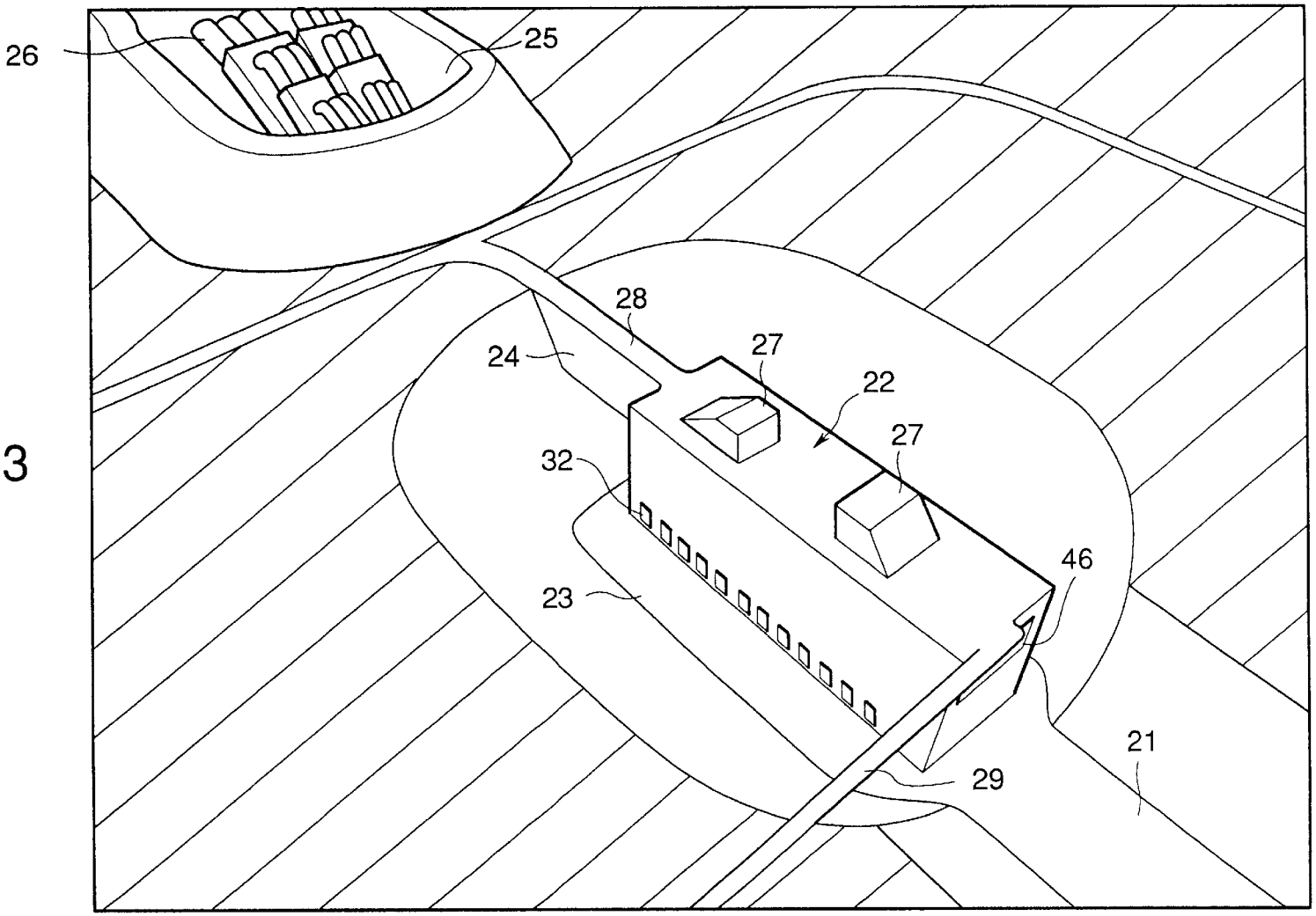
FIG. 3 is a representation showing an entire construction of a water conveying system to which the pumping plant of the present invention is applied.
Figure 4:
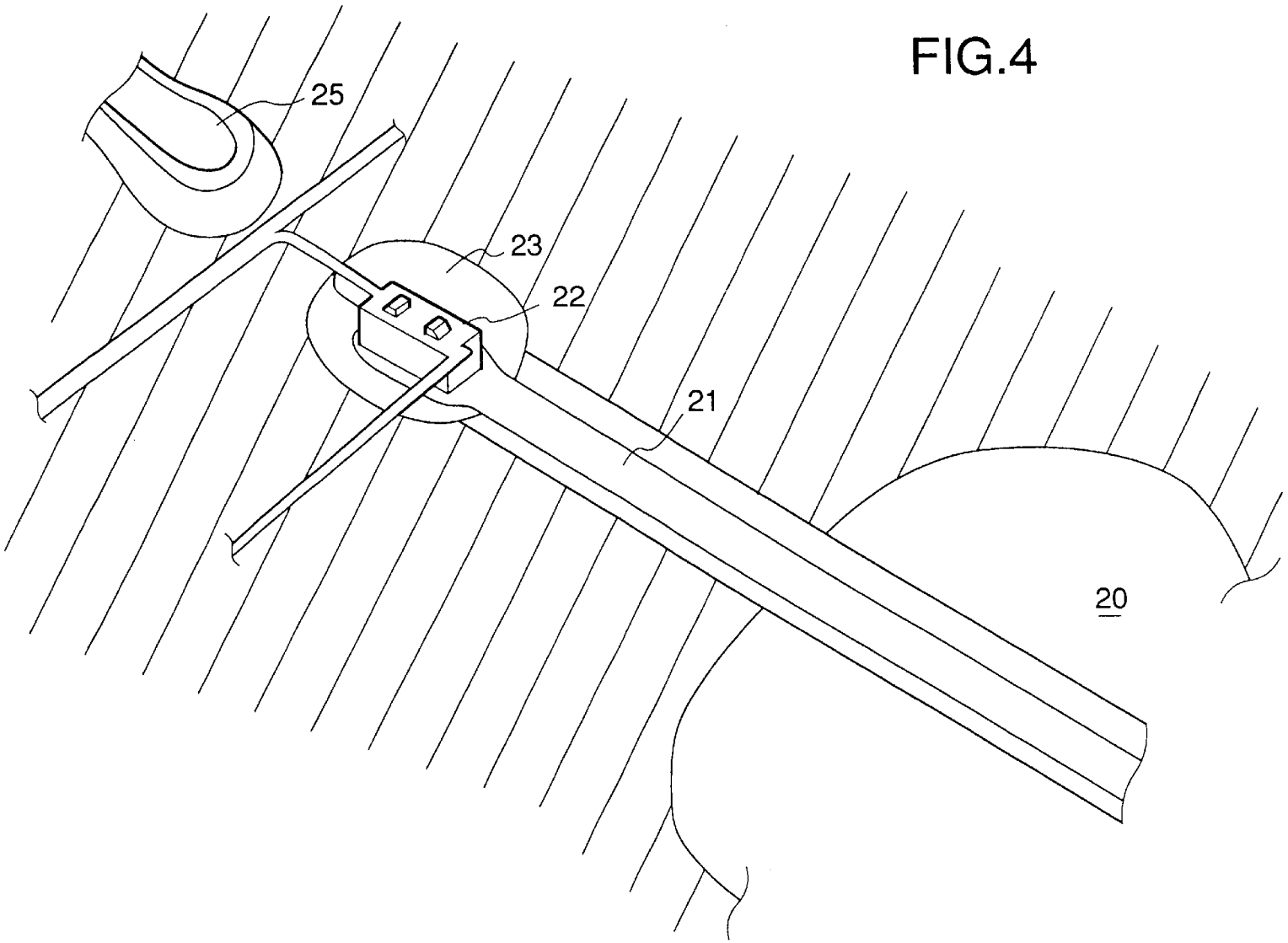
FIG. 4 is a conceptual representation of the water conveying system to which the pumping plant of the present invention is applied.
Figure 5:
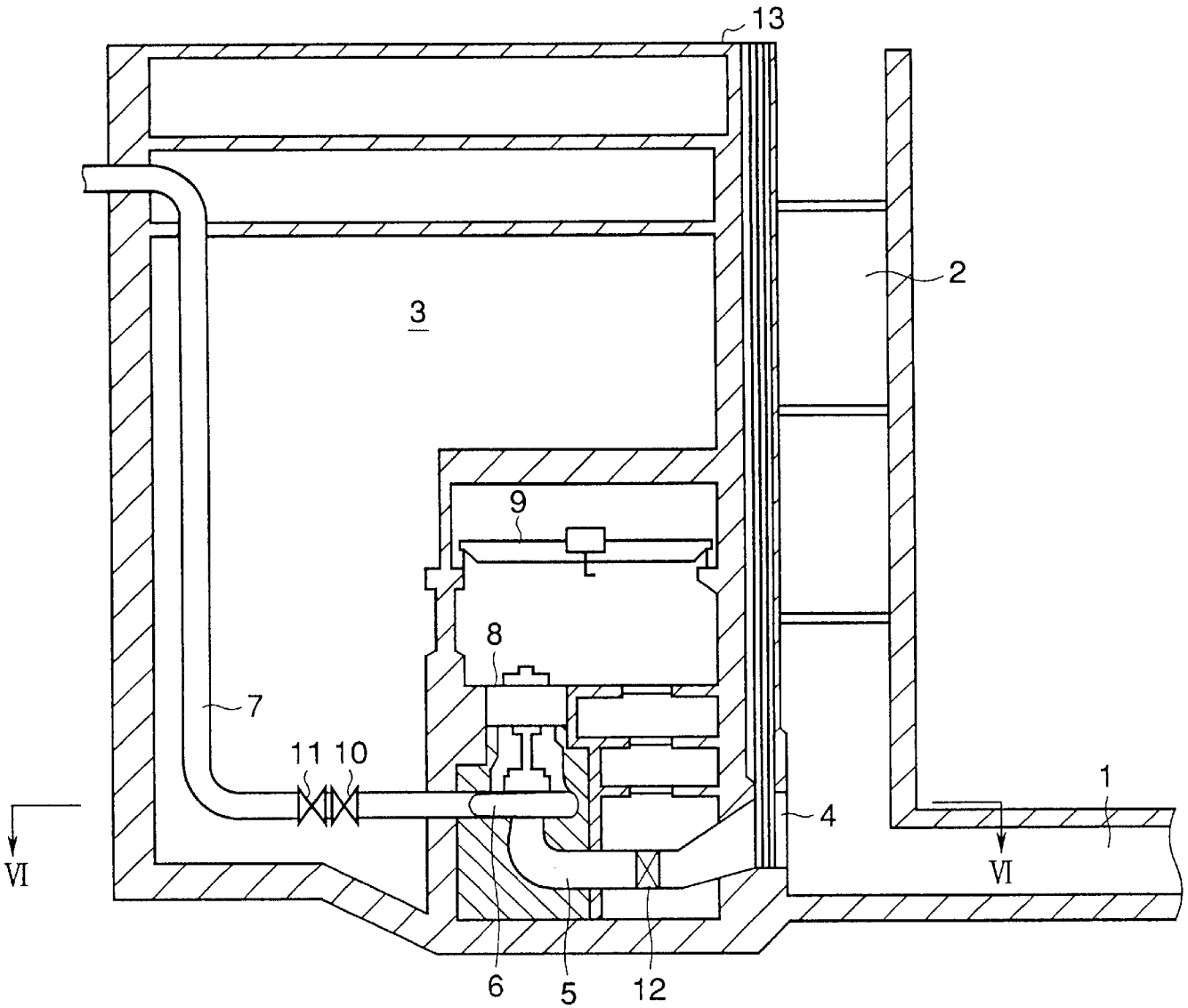
FIG.5 PRIOR ART
FIG. 5 is a vertical sectional view of a conventional pumping plant.
Figure 6:
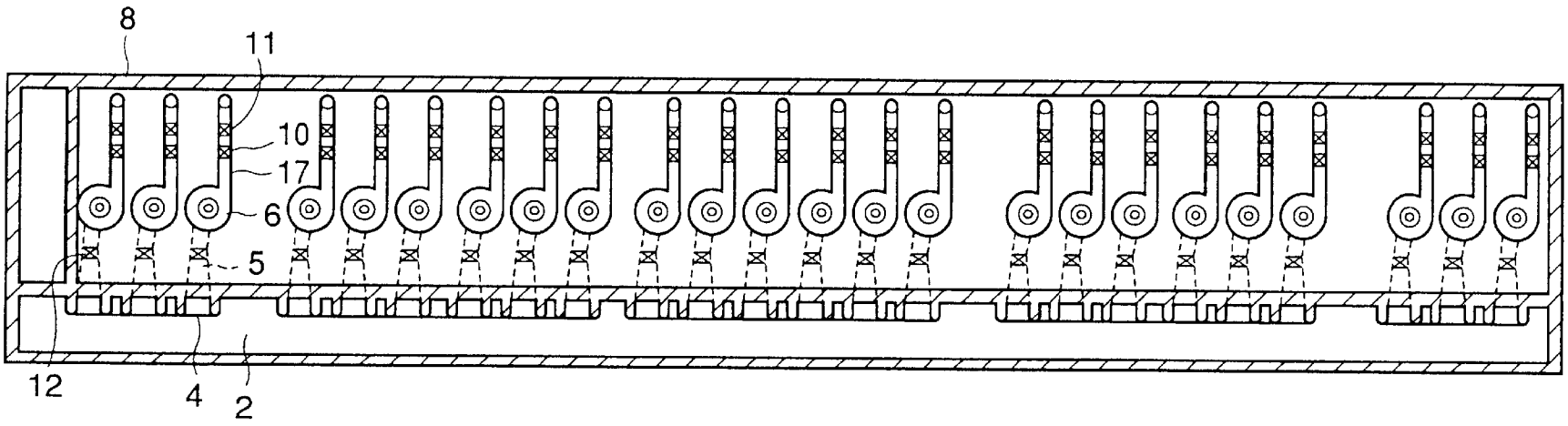
FIG.6 PRIOR ART
FIG. 6 is a sectional view taken along line VI—VI in FIG. 5 and viewed in a direction denoted by arrows.

A preferred embodiment of the present invention, shown in FIGS. 1 to 4, will be described below. FIG. 1 is a vertical sectional view of a pumping plant according to one embodiment of the present invention. FIG. 2 is a sectional view taken along line II—II in FIG. 1 and viewed in a direction denoted by arrows. FIGS. 3 and 4 each show an appearance of a water conveying system to which the pumping plant of the present invention is applied.

As shown in FIGS. 3 and 4, water taken in at a water taking-in point, such as a lake 20, is introduced from there to a suction pond 23, in which a pumping plant 22 is constructed, through a suction water channel 21 in the form of an open water conduit. The suction pond 23 is positioned at a terminal end of the suction water channel 21. The suction pond 23 is formed by digging down the ground to a desired depth to create an oblong cone-shaped depression, and protecting a bottom surface and a surrounding slope with concrete walls. The suction pond 23 serves as a suction well for pumps, and the pumping plant 22 is constructed on the flat bottom surface at the center of the suction pond 23. In other words, the pumping plant 22 is formed just as an island in the suction pond 23. The pumping plant 22 sucks water in the suction pond 23 and convey the water to a delivery water tank 25 or the like through delivery pipes laid respectively in a bundle of concrete conduits 24. Siphon pipes 26 are provided in the delivery water tank 25. The siphon pipes 26 are disposed at terminal ends of the delivery pipes 35 and are shaped so as to develop siphonage. Access buildings 27 are provided on the rooftop of the pumping plant 22 to serve as an entrance and exit of the pumping plant 22 to and from the exterior. In the access buildings 27, there are provided elevators, stairs and other installation allowing operators to go up and down in the pumping plant 22. Further, as passages for access from the surrounding of the suction pond 23 to the pumping plant 22, a connection passage 28 is formed on a top surface of the bundle of concrete conduits 24, and a bridge 29 is laid to extend from the bank of the suction pond 23 to the rooftop of the pumping plant 22.

A structure of the pumping plant 22 will be described in detail with reference to FIGS. 1 and 2. As shown in FIG. 2, a pump building 30 of the pumping plant 22 is formed to have a rectangular shape in a plan view, and includes a plurality (24 units in the illustrated embodiment) of pumps 31 which are arranged in the longitudinal direction of the pump building 30 to lie in two rows separate from each other in the widthwise direction thereof. The direction of the rows is parallel to the direction of flow of water incoming from the suction water channel 21 to the suction pond 23. The pump building 30 is constructed on a central bottom portion of the cone-shaped suction pond 23. Suction openings 32 are formed in a bottom portion of each of opposite longitudinal side walls of the pump building 30 to be opened to the suction pond 23. The suction opening 32 is communicated with a suction port of each pump 31 through a suction pipe 33 in the form of a steel pipe, which is laid to extend substantially horizontally. A suction valve 39 for use in maintenance work of the work 31 is disposed in a horizontal portion of the suction pipe 33.

The pump 31 is driven by a motor 34, as a prime mover, provided above the pump 31. A delivery port of the pump 31 is communicated with a delivery water tank 25 through a delivery pipe 35 in the form of a steel pipe. The delivery port of the pump 31 has the center set to a position lower than the lowest water suction level (LWL) of the suction pond 23. The delivery pipe 35 is disposed to substantially horizontally extend from the pump delivery port to a position near an inner wall of the pump building 30 and then extend upward from the position near the inner wall toward an upper portion of the pump building 30. Each of the concrete conduits 24, which is rectangular in cross-section, is disposed in the upper portion of the pump building 30 to extend in the longitudinal direction thereof. The delivery pipe 35 is laid in the concrete conduit 24 and is extended up to the delivery water tank 25. In other words, the concrete conduit 24 serves to protect the delivery pipe 35 over a range from the pumping plant 22 to the delivery water tank 25. Additionally, the bundle of concrete conduits 24 serves as not only a part of the structure of the pump building 30, but also the connection passage 28 from an external area to the pumping plant 22.

A hydraulic valve 37 and an electric-powered valve 38 are provided in a vertical portion of the delivery pipe 35. The hydraulic valve 37 is used when the operation of the pump 31 is started and stopped. The electric-powered valve 38 is disposed in the vertical portion of the delivery pipe 35 downstream of the hydraulic valve 37, i.e., above the hydraulic valve 37 in this embodiment, and is used in maintenance work of the pump 31 and the hydraulic valve 37.

A main floor 40 is provided at a level substantially flush with an upper surface of the motor 34. The hydraulic valve 37 in the delivery pipe 35 is positioned at a level close to the main floor 40. The electric-powered valve 38 is positioned just above the hydraulic valve 37. A ceiling crane 41 is provided at a level spaced from the main floor 40 upward, and is able to run in the longitudinal direction of the pump building 30. More specifically, the ceiling crane 41 is a crane provided in the pumping plant 22 for installation and maintenance of equipment such as the pumps 31, the motors 34 and the suction valves 39. Corresponding to the number (=two) of rows of the pumps 31, two ceiling cranes are provided in this embodiment. It is therefore possible to carry out installation and maintenance of the pumps 31, etc. on both sides at the same time. Further, an opening is formed in a portion of the main floor 40 positioned above the suction valve 39 so that the suction valve 39 can be installed in a predetermined position by using the ceiling crane 40 and maintenance work of the suction valve 39 can be made from the main floor 40.

In an upper portion of the pump building 30 near the rooftop, there is provided an electric apparatus floor 43 on which a plurality of electric apparatus 42 are mounted. The electric apparatus 42 include various units of power source equipment and control equipment to be installed in the pumping plant 22. The position of the electric apparatus floor 43 is set to a level be higher than a maximum full water level (MFL) of the suction pond 23. A service floor 44 is provided at a level one step lower than the electric apparatus floor 43. The service floor 44 is positioned in the upper portion of the pump building 30, but no equipment are installed on the service floor 44. A cavity 45 defined between the service floor 44 and the electric apparatus floor 43 includes an opening 46 which is formed in a transverse side wall of the pumping plant 22 on the side toward the suction water channel 21, as shown in FIG. 3. Also, though not appearing in FIG. 3, a similar opening to the opening 46 is formed in an opposite transverse side wall of the cavity 45 on the side toward the delivery water tank 25. In addition, corresponding to each of the suction openings 32, two guide grooves 47 are formed on the longitudinal side wall of the pump building 30 to extend from the bottom to the top of the pump building 30 so that a screen and a gate for removing foreign matters are slidably attached to and detached from the suction openings 32 through the guide grooves 47.

The operation of a water conveying system including the pumping plant thus constructed will now be described below. Water is taken in from the lake 20 whose water level varies to a large extent depending on years and seasons. The water flowing from the lake 20 into the suction pond 23 through the suction water channel 21 is introduced to the interior of the pumping plant 22 from the suction openings 32 formed in both the longitudinal side walls of the island-type pumping plant 22, the plant 22 being partly submerged under the water in the suction pond 23. The water coming into the pumping plant 22 from the suction openings 32 reaches the pumps 31 through the suction pipes 33 and is then sucked by the pumps 31. With such a construction that the pumping plant 22 is located in the suction pond 23 and the plurality of pumps 31 are arranged in two rows parallel to the direction of flow of the water incoming from the suction water channel 21 to the suction pond 23, the water can be sucked by the two rows of pumps 31 in a well balanced manner. Also, because the pumps 31 are arranged in two rows, the longitudinal length of the pumping plant 22 can be shortened in comparison with the conventional pumping plant in which pumps are arranged in one row.

The water delivered from each pump 31 is introduced to the delivery pipe 35 which is arranged on the same side as the suction pipe 33 with respect to the pump 31 and is extended horizontally in an offset relation to the suction pipe 33 in a plan view. Thus, since the suction pipe 33 and the delivery pipe 35 are positioned not to overlap with each other as viewed from above, the presence of the delivery pipe 35 causes no interference when the suction valve 39 is mounted over the suction pipe 33 from the main floor 40. The delivery pipe 35 is bent 90° upward at a position near the longitudinal inner wall of the pump building 30 to rise vertically from there. The hydraulic valve 37 and the electric-powered valve 38 are provided in the vertical portion of the delivery pipe 35 at a position close to the main floor 40. It is therefore easy to attach and detach those valves. For example, the hydraulic valve 37 is disposed such that its lower flange face locates within one meter from an upper surface of the main floor. 40. Then, the electric-powered valve 38 is disposed just above the hydraulic valve 37.

The delivery pipe 35 rising vertically along the longitudinal inner wall of the pump building 30 is laid in the concrete conduit 24 which has a rectangular cross-section and is disposed in the upper portion of the pump building 30 to extend in the longitudinal direction thereof. The delivery pipe 35 is extended up to the delivery water tank 25. The water introduced to the delivery water tank 25 is spouted into the delivery water tank 25 through the siphon pipes 26 disposed at the terminal ends of the delivery pipes 35.

With the embodiment shown in FIG. 1, as described above, since the pumping plant 22 is constructed in the suction pond 23 serving as a pump well, the necessity of refilling earth and sand around the pumping plant 22 is eliminated, and civil engineering works associated with the construction of the pumping plant 22 are simplified. This is effective in reducing a total construction cost and cutting down a term of the entire construction work.

Also, the suction openings 32 are formed in the opposite two longitudinal side walls of the pumping plant 22 near the bottom thereof, which is constructed in the suction pond 23, the pumps 31 are arranged within the pumping plant 22 in two rows in a symmetrical relation, and the delivery pipes 35 of the pumps 31 are disposed on the same side as the suction pipes 33 with respect to the pumps 31. Because of that structure, the size of the pumping plant 22 as viewed at least from above can be made compact. Especially, since the pumps 31 are arranged to lie in match with the direction of flow of the water incoming from the suction water channel 21 to the suction pond 23, the water can be sucked by the two rows of pumps 31 in a well balanced manner. In the illustrated embodiment, the pumps 31 are arranged, by way of example, in two rows corresponding to the suction openings 32 formed in the two longitudinal side walls of the pumping plant 22. However, the suction openings 32 may be formed in the four longitudinal side walls of the pumping plant 22. It is a matter of course that the plurality of pumps 31 may be arranged in three or more rows in parallel.

Further the bundle of concrete conduits 24 are extended from the pumping plant 22 to the delivery water tank 25 across the suction pond 23. Then, in the illustrated embodiment, a road is constructed on the bundle of concrete conduits 24 to provide the connection passage 28 leading to the pumping plant 22 from the exterior, as shown in FIG. 3. Accordingly, the connection passage 28 can be constructed more economically than the case of laying a bridge separately. Moreover, since the bridge 29 serving as another connection passage is laid to extend from the bank of the suction pond 23 to the pumping plant 22, vehicles such as cranes and trucks can be smoothly traveled to and from the pumping plant 22 in combination with the connection passage 28. While a total two of connection passage and bridge are provided in the illustrated embodiment, it is needless to say that the connection passage and the bridge may be provided in any desired number.

While the illustrated embodiment employs the concrete conduits 24 in the same number as the plurality of the delivery pipes 35, all the delivery pipes 35 may be laid in a large-diameter concrete conduit together. As an alternative, it is also possible to divide the delivery pipes 35 into several groups and to lay each group of the delivery pipes in one relatively large-diameter concrete conduit.

Additionally, since the electric apparatus 42 are mounted on the electric apparatus floor 43 is provided at a level higher than the maximum full water level (MFL) of the suction pond 23, the electric apparatus 42 mounted on the electric apparatus floor 43 can be avoided from being submerged under water even if the water in the suction pond 23 should flow into the pumping plant 22, or even if any of the pipes in the pumping plant 22 should be broken.

Moreover, when the water level in the suction pond 23 rises, the buoyancy acting upon the entire pumping plant 22 is increased correspondingly. In the illustrated embodiment, the cavity 45 is formed in the pumping plant 22 to be capable of communicating with the pumping plant 22 through the opening 46 and so on. Therefore, when the water level in the suction pond 23 rises above the service floor 44, the water in the suction pond 23 flows into the cavity 45, and hence an increase of the buoyancy is suppressed correspondingly.

While the embodiment has been described above in connection with the case of constructing the pumping plant in the form of an island in the suction pond, the present invention is not limited to the illustrated embodiment, but also includes the case of constructing the pumping plant in the form of an island in the suction pond adjacent to the bank of the suction pond. More specifically, the pumping plant may be constructed such that one or three side walls are submerged under the water in the suction pond. In this modification, earth and sand must be refilled around three or one outer walls of the pump building adjacent to the bank of the suction pond, but it is not needed to refill earth and sand around the side walls submerged under the water. As a result, associated civil engineering works can be simplified correspondingly.

According to the present invention, as described above, since the pumping plant is constructed in the form of an island in the suction pond, a total cost required for construction work of the pumping plant and associated civil engineering works such as digging down the ground can be reduced, and a term of the entire construction work can be cut down.

Also, since the pumps are arranged within the pumping plant in two rows parallel to the direction of flow of water incoming from the suction water channel to the suction pond and the delivery pipes are disposed on the same side as the suction pipes with respect to the pumps, the size of the pumping plant can be made compact. As a result, a total cost required for construction work of the pumping plant and associated civil engineering works such as digging down the ground can be reduced, and a term of the entire construction work can be cut down. Further, by providing valves, which are to be mounted on the delivery pipes, in the vertical portions of the delivery pipes, the plant size can be made more compact.

In addition, since the electric apparatus floor, on which the electric apparatus are mounted, is provided at a level higher than the maximum full water level of the suction pond, a risk of the electric apparatus being submerged under water can be avoided.

What is claimed is:

1. A pumping plant for conveying a liquid, the pumping plant comprising:

a suction pond formed by excavating down into the ground;

a suction liquid channel to introduce liquid from a liquid intake point to said suction pond;

a pump building disposed on a floor of said suction pond and comprising an island disposed in said suction pond;

a plurality of pumps disposed in said pump building, at least a portion two longitudinal side walls of said pump building being submerged under liquid in said suction pond; and a plurality of suction openings disposed on said at least a portion of said two longitudinal side walls of said pump building, each of said plurality of suction openings communicating with a suction port of a corresponding one of said plurality of pumps;

said plurality of pumps being arranged in double rows in parallel to a direction of flow of the liquid introduced from said suction liquid channel to said suction pond;

said pumps being disposed such that a center of a delivery port of each of said pumps is at a level lower than a lowest liquid suction level;

said pumping plant further comprising:

suction pipes each disposed between a corresponding one of said suction openings and a suction port of a corresponding one of said plurality of pumps; and delivery pipes each coupled to a delivery port of a corresponding one of said plurality of pumps;

each one of said delivery pipes being disposed above a corresponding one of said suction pipes.

2. The pumping plant according to claim 1, further comprising at least one bridge disposed between a bank of said suction pond and said pump building to serve as a connection passage therebetween.

3. The pumping plant according to claim 1, further comprising an access building disposed on a rooftop of said pump building to serve as an entrance to and an exit from said pump building.

4. The pumping plant according to claim 1, each one of said delivery pipes having a portion extending vertically and each one of said delivery valves being disposed in said vertical portion of a corresponding delivery pipe at a position allowing access to said delivery valve.

5. The pumping plant according to claim 1, wherein said pump building comprises a floor disposed at a level higher than a maximum full liquid level and further comprises electric apparatus mounted on said floor.

6. The pumping plant according to claim 1, wherein said pump building comprises a cavity penetrating opposite side walls thereof, said cavity communicating with said suction pond.

7. The pumping plant according to claim 1, further comprising:

a liquid delivery tank located remotely from said suction pond into which liquid is conveyed from said suction pond; and a plurality of concrete delivery conduits extending from said pumping plant to said liquid delivery tank, each of said concrete delivery conduits having at least one of said delivery pipes disposed therein.

* * * * *